US008082649B2

(12) United States Patent
Rider

(10) Patent No.: US 8,082,649 B2
(45) Date of Patent: Dec. 27, 2011

(54) ROOF-SEAMING APPARATUS INCLUDING AN ADJUSTABLE PANEL GUIDE

(75) Inventor: Terry L. Rider, Corinth, MS (US)

(73) Assignee: Developmental Industries, Inc., Corinth, MS (US)

( * ) Notice: Subject to any disclaimer, the term of this patent is extended or adjusted under 35 U.S.C. 154(b) by 650 days.

(21) Appl. No.: 12/584,071

(22) Filed: Sep. 26, 2008

(65) Prior Publication Data

US 2010/0077697 A1 Apr. 1, 2010

(51) Int. Cl.
*B23P 11/00* (2006.01)
*E04B 1/00* (2006.01)

(52) U.S. Cl. ..... 29/509; 52/748.1

(58) Field of Classification Search ..... 29/509, 29/514, 428, 243.5, 243.58, 293.57; 52/748.1, 52/749.12; 72/48, 121, DIG. 1, 210, 298
See application file for complete search history.

(56) References Cited

U.S. PATENT DOCUMENTS

| | | | | |
|---|---|---|---|---|
| 2,171,297 | A | | 2/1939 | Zahner et al. |
| 2,160,336 | A | | 5/1939 | Maxfield |
| 3,610,191 | A | | 10/1971 | Harris, Jr. |
| 3,662,699 | A | * | 5/1972 | Horn et al. ..... 29/243.5 |
| 3,771,482 | A | | 11/1973 | Thompson |
| 4,027,611 | A | | 6/1977 | Ward et al. |
| 4,168,596 | A | | 9/1979 | Yoder, Jr. |
| 4,470,186 | A | | 9/1984 | Knudson |
| 4,726,107 | A | | 2/1988 | Knudson |
| 4,918,797 | A | | 4/1990 | Watkins et al. |
| 4,989,308 | A | | 2/1991 | Sanders |
| 5,142,838 | A | | 9/1992 | Simpson et al. |
| 5,303,528 | A | | 4/1994 | Simpson |
| 5,604,966 | A | | 2/1997 | Morello et al. |
| 5,685,118 | A | | 11/1997 | Simpson |
| 5,697,197 | A | | 12/1997 | Simpson |
| 5,737,894 | A | | 4/1998 | Simpson et al. |
| 5,935,357 | A | | 8/1999 | Hubbard et al. |
| 5,991,993 | A | | 11/1999 | Knudson |
| 6,115,899 | A | | 9/2000 | Rider |
| 6,187,122 | B1 | | 2/2001 | Hubbard et al. |
| 6,499,203 | B2 | | 12/2002 | Morella |
| 6,588,170 | B2 | | 7/2003 | Simpson et al. |
| 6,722,087 | B1 | | 4/2004 | Morella |
| 6,889,478 | B1 | | 5/2005 | Simpson |

* cited by examiner

*Primary Examiner* — John C Hong
(74) *Attorney, Agent, or Firm* — William S. Parks; Wyatt, Tarrant & Combs, LLP

(57) ABSTRACT

An apparatus for the seaming of roof assemblies for a building structure, wherein the apparatus includes an adjustable panel guide for the initial alignment of panel edges to a position uniform to that necessary for engagement of horizontal rollers to perform the seaming procedure is provided. Such an apparatus thus permits the utilization of virtually any type of metal paneling to create the desired roof assembly, with the capability of providing a secure, reliable seal within the seam to increase the waterproofing and uplift protection potential thereof as well as to best ensure the seaming apparatus does not jam or otherwise fail during the seaming process itself. The versatility permitted with such an apparatus allows for utilization of imperfectly shaped and/or configured panels for elevated seamed roof assembly purposes. The method of seaming with such an apparatus is also encompassed within this invention.

2 Claims, 20 Drawing Sheets

ROOF-SEAMING APPARATUS INCLUDING AN ADJUSTABLE PANEL GUIDE

FIELD OF THE INVENTION

The present invention relates to an apparatus for the seaming of roof assemblies for a building structure, wherein the apparatus includes an adjustable panel guide for the initial alignment of panel edges to a position uniform to that necessary for engagement of horizontal rollers to perform the seaming procedure. Such an apparatus thus permits the utilization of virtually any type of metal paneling to create the desired roof assembly, with the capability of providing a secure, reliable seal within the seam to increase the waterproofing and uplift protection potential thereof as well as to best ensure the seaming apparatus does not jam or otherwise fail during the seaming process itself. The versatility permitted with such an apparatus allows for utilization of imperfectly shaped and/or configured panels for elevated seamed roof assembly purposes. The method of seaming with such an apparatus is also encompassed within this invention.

BACKGROUND OF THE INVENTION

Standing seam roof assemblies have been utilized for simpler manufacturing, particularly in order to reduce complexity in erecting buildings. In such assemblies, numerous panels are supplied with differing end portions, each having what is termed a female portion and a smaller male portion. In such a manner, the panels are laid one next to the other and secured through seaming the male and female portions of adjacent panels together. Such roof assemblies are designed to provide excellent watertight seals as well as effective wind resistance to ensure leak-proof structures as well as high stability against updrafts. Additionally, the seams include panel portions that are allowed to flex to compensate for temperature variations so the roof itself will not disintegrate upon contraction or protraction. For simplification of the overall assembly system, the seamed panels are attached to the building structure via brackets or like components, at a limited number of points in each connected panel. Thus, it is very important to provide excellent seal strengths upon seaming of such individual roof assembly panels together in order ensure the roof assembly does not destabilize at the seam attachment points. As well, the seaming procedure is generally accomplished through the utilization of a motorized seaming apparatus that moves along the length of overlapping edges of adjacent panels. Such an apparatus thus when engaged for seaming at the panel edges relies upon the proper alignment of the edges with the apparatus itself to properly function in a seaming capacity as well as smoothly move along the panel lengths themselves. Any imperfections in the shape or position of the panel edges may skew not only the finished seam, but also potentially cause the motorized apparatus to jam or otherwise fail during utilization itself.

The panels themselves are made generally from metal materials that exhibit excellent strength characteristics, low propensity for rusting, and, of great importance, suitable flexibility for seaming to be accomplished. The seam between the two panels provides not only waterproof seals between panels, but also the ability to hold the two panels together effectively to prevent or at least substantially reduce any slippage between them, as alluded to above. Any appreciable reduction in the dimensional stability of the roof assembly itself would result in roof failure from a leakage perspective, at least. Again, however, it is very difficult to actually provide uniform shapes and/or configurations of such panels, particularly in terms of the angles of the edge portions that must overlap between male and female portions of adjacent panels. At the installation site, it has been such a problem that a user must do his or her best to maneuver the edge portions of panels to meet the necessary overlapping positions for proper seaming and overall installation to occur. This is of particular concern when the panels themselves do not exhibit structural uniformity, specifically in terms of the angles at which the overlapping female and male portions are disposed. Imperfections in the roof panels require intensive modification through on-site estimates as to the proper alignment settings of the seaming rollers within the seaming apparatus itself. This deficiency can lead to aesthetically displeasing roof assembly results, not to mention the potential seam failures if the estimations are incorrect. The ability to take virtually any set of roofing panels together and seam them is thus highly desired.

To attempt to compensate for such problems, past developments have included seaming apparatuses including stationary damping posts that provide some semblance of uniform starting positions for the engagement of seaming rollers. Unfortunately, such stationary damping posts do not always align with the seaming rollers themselves; any misalignment between such different seaming apparatus components would result in the same potential skew problems such developments were intended to remedy. Likewise, some seaming methods have included adjustable damping mechanisms to provide differing angles for the panel edges prior to seaming roller engagement. However, these previous adjustable mechanisms are based on swing levers and only provide angular deflections in the panel edges; no uniformity with the desired initial positioning of the seaming rollers for proper straight seams to form are possible with such swing levers. Furthermore, these were always independent of the adjustments provided for the seam rollers themselves. It was thus incumbent upon the installer to properly estimate the degree of edge deflection necessary by the swing lever device to meet the requirements of the seam rollers. The lack of definitive angle uniformity has thus created much of the same problems as noted above as well. Improvements in such previous attempts at providing greater reliability in elevated roof assembly seaming procedures have been so limited; something more has been needed within this industry to allow for greater efficiency in roof assembly with little fear of seaming apparatus failure, not to mention failure of such roof seams as well. To date, there has been nothing that permits greater reliability than these deficient developments.

Importantly, it has also been realized that such seams may be configured to exhibit varying shear strengths to reduce slipping between the panels; it is thus important, though not required, to provide the strongest joint seal possible, with the lowest degree of manufacturing complexity and the highest level of safety for the builder as well. In the past, the female portion of each panel was produced with an extra hook that permitted an extra joint to be created over the outer edge of the male portion of the adjacent panel. Such a hook thus provided a more robust seal to be attained at the seam after suitable pressure was applied over the entire panel. It has been measured that a seam including such a hook portion can increase the strength of the seam by at least 50% over a non-hook design at a five foot purlin spacing; at a 2½ foot purlin spacing, the increase is even more dramatic, about 75%. Thus, the inclusion of such a hook within the female portion of a panel to be seamed to a male portion of an adjacent panel provides excellent shear strength properties, according even greater reliability as a leak-proof and wind-proof roof assembly. Unfortunately, the typical hook design (wherein the panels are provided with such a hook on the edge of a female portion prior to transport to a building site and placement on a target edifice) has created some noticeable problems that have yet to be overcome.

Such roof assemblies require intensive manpower to first lift and place the panels as needed, and further to initialize the sealing procedure. At a roof height of at least 12 feet, it is imperative for safety purposes to facilitate such roof assembly procedures through simplifying the procedure and best ensuring that cumbersome lifting movements are reduced. With previously produced panels including hook designs within the female portions thereof, instead of a simple placement of the target panels over one another and subsequently seaming such, it has been necessary to actually lift each panel in succession and make sure the hooked female portions actually engage the smaller male portions prior to seaming through a roll-lock procedure. In such a manner, safety precautions must be undertaken to permit such labor intensive actions. The panels themselves are generally quite heavy and mere placement aids in reducing the strain and possible safety compromises that are readily present when the typical pre-hooked panels are utilized. As such, there exists a definite need to provide a simpler, yet just as reliable, manner of seaming standing roof assembly panels.

A need has thus has also long been recognized for providing such high strength roof assemblies but without the potential dangerous and labor intensive lifting of panels due to the pre-hooked designs used therein. Such pre-hooked panels are generally produced at a panel production plant, rather than on-site at the building location. However, even were such panels produced on-site, the same issues with lifting rather than placing of the panels would be an issue. A manner of actually creating a hook to be integrated within a panel after placing in the target roof location is thus a desired outcome. To date, unfortunately, such a result has not been accorded the metal roofing industry.

ADVANTAGES AND SUMMARY OF THE INVENTION

One distinct advantage of the inventive apparatus and method is to provide extremely strong seals at the female/male portion interface of an elevated seam roof assembly. Additionally, a distinct advantage of the inventive seaming apparatus is the ability to substantially align a damping post with a first seaming roller in every instance, thereby imparting a uniform initial crimp within the subject panel edges along an entire overlapped panel length. Yet another advantage of such an inventive apparatus is the reliability provided to the user that the motorized apparatus will not jam or otherwise fail during installation due to improperly aligned overlapping edges.

Accordingly, this invention encompasses a roof panel seaming apparatus including a plurality of rollers attached in rotatable relation to a base aligned for engagement with female and male roof panel portions of separate but adjacent panels at the same time and at least one damping post present on the apparatus in adjustable relation to at least one of said rollers, wherein said female and male roof panel portions have overlapping edges when placed one over the other in parallel fashion, wherein said rollers create a seam between said female and male roof panel portions when activated along the length of said roof panel portions, and wherein said damping post provides a uniform positioning of said overlapping edges in relation so said at least one roller over the length of said roof panel portions. Also encompassed within this invention is a method of creating a seam between two roof panels including a female edge portion and a male edge portion present in overlapping relation to one another, said method comprising:

a) providing a first roof panel having an elevated female end portion and an opposite elevated male portion, said female portion having an edge, and said male portion having an edge substantially parallel to said female portion edge, providing a second roof panel substantially identical to and having the same type of female and male end portions as said first roof panel, wherein said first and second roof panels are placed in overlapping, parallel relation to each other, wherein said female end portion of said first roof panel is present over said male end portion of said second roof panel;

b) placing an apparatus including a plurality of rollers attached in rotatable relation to axles aligned for engagement with female and male roof panel portions of separate but adjacent panels at the same time and at least one damping post present on the apparatus in adjustable relation to at least one of said rollers over an initial length of the overlapping edges of said female and said male end portions of said first and second roof panels;

c) simultaneously adjusting said damping post and said at least one roller with the same control to a proper alignment for seaming of said overlapping end portions;

d) activating said apparatus thereby permitting automatic movement of the apparatus over the overlapping end portions of said first and second roof panels in a direction parallel to the direction in which said first and second roof panels are placed on said roof; and e) removing said apparatus upon completion of movement over said overlapping first and second roof panel end portions.

In this manner, an entire roof assembly including such particular panels having elevated end portions for seaming may be reliably attached to one another in series. The resultant roof provided by such seamed joints thus exhibits excellent strength due to the uniform seams present therein.

As alluded to above, safety is of extreme concern with any occupation that requires intensive labor at elevated heights off of the ground. In the roofing industry, it is evident that an edifice is first erected through providing the building skeleton (girders, beams, etc.) as well as potentially, particularly for commercial buildings, brick, stone, or other like materials for outside walls. The roof thus must be constructed on site, and atop the building skeleton. Multiple types of roofing materials could be utilized for such a purpose; the types at which the inventive apparatus and method are directed are those that involve relatively long, but relatively narrow, panels that, as discussed throughout, are attached through seams to produce a single roof assembly. Such panels include the elevated female and male members as noted above for such seaming purposes; in addition, though, the seams provide excellent characteristics in relation to thermal expansion and contraction possibilities, in addition to the low slippage and water-tight properties highly desired. The stronger the seam, however, the better the overall protection to the roof assembly from damaging high winds.

Such panels are generally made from different gauge metals (such as steel, stainless steel, aluminum, and the like), and are selected in terms of their load properties, among other reasons. The flexibility of the panels is important in terms of the above-discussed characteristics for thermal expansion and wind resistance; however, the load itself also contributes to the potential difficulties with seaming of the elevated end portions together as well. This potential issue can be compensated for with a proper motorized seaming apparatus (such as a motor attached to a movable base) exhibiting the proper torque to maneuver the female and male end portions as needed for proper seaming to be accomplished. Generally, aluminum exhibits the lowest gauge and thus is easier on the motor of the seaming apparatus; however, such a material also exhibits the least reliability in terms of roof assembly panels as well, due to its malleability level. Steel and stainless steel (and other like higher gauge metals) are thus preferred. Additionally, to protect from environmental and water damage, the metal surface is usually accorded a proper coating (anti-rust paint, for example).

Furthermore, the adjacently disposed roof panels are supported by an underlying support structure to which the panels may also be attached through clips or other like objects. Backer and/or cinch plates may be added to the overlapped edge seams in the roof assembly as well, if desired, to increase the overall strength of the roof.

The features, benefits and advantages of the present invention will become apparent from the following detailed description when read in conjunction with the drawings and appended claims.

DETAILED DESCRIPTION OF THE DRAWINGS

Figure 1:
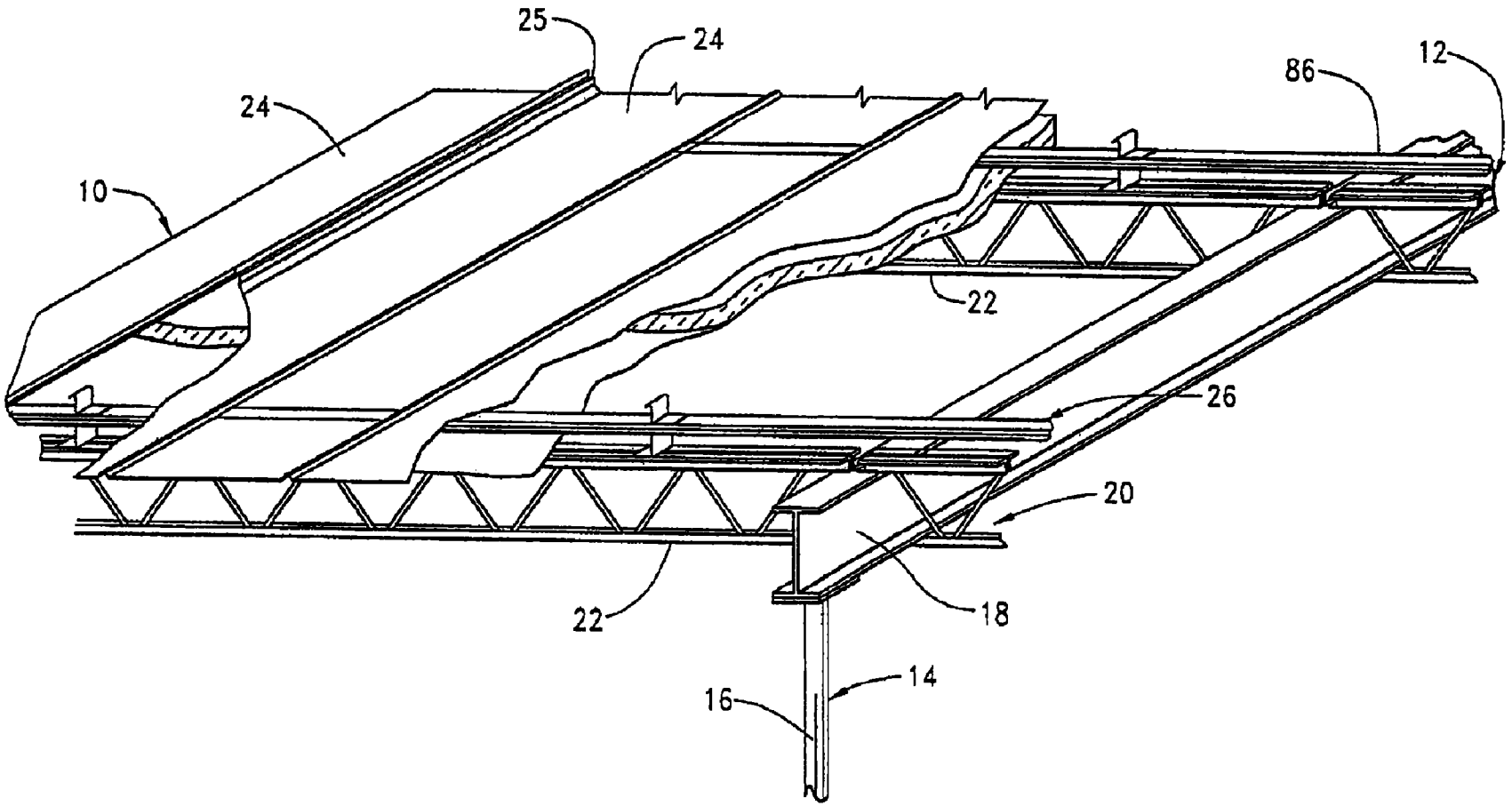
FIG. 1 is an isometric, partial cut-away view of a portion of a roof system utilizing a standing seam roof assembly.

Referring to FIG. 1, there is depicted a pre-engineered building roof 10 supported by a pre-engineered building structure 12. Such a pre-engineered structure 12 comprises a primary structural system 14 including a number of upwardly extending column members 16 [to be connected to a base foundation (not illustrated)]. Also, the primary structural system 14 has a plurality of beams 18 which are supported by the column members 16.

Also included is a secondary structural system 20 including a number of open web beams 22 attached to and supported horizontally by the primary beams 18. Alternative structures may be employed in place of these web beams 22, if desired. A plurality of roof panels 24 are supported over the secondary structural assembly 20 by a plurality of panel support assemblies 26 and are attached to the upper flanges of the web beams 22. The roof panels 24, only portions of which are shown, are depicted as being standing seam panels with interlocking standing seams 25 connected by clip portions of the panel support assemblies 26. Alternatives to such clips may be practiced as well and other clips may be incorporated within the panels to hold them in place with the building skeletal portions noted above.

Figure 2:
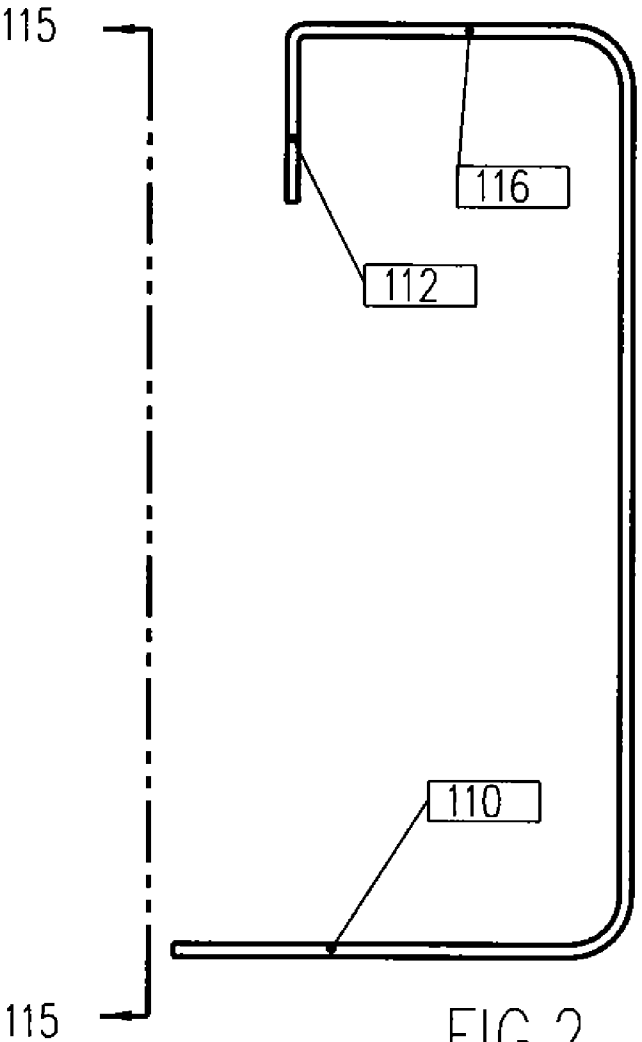
FIG. 2 is a cross-sectional view of the male end portion of a roof panel.

FIG. 2 depicts the male end portion 115 of an end panel (partially shown as 110). The end portion 115 includes an elevated end component 114 that bends substantially 90 degrees from the plane of the panel 110 that leads into a top end component 116 that bends substantially 90 degrees from the plane of the elevated end component 114 back toward the panel 110 and is substantially parallel to the panel itself 110. Another substantially 90 degree bend in the material then leads to an edge portion 112 being the edge of the entire panel 110 on the male portion side 115. This edge portion 112 is parallel with the elevated end component 114. The top end component 116 is thus raised to a predetermined height through the length of the elevated end component 114. The edge portion 112 is extended a predetermined length from the top end portion 116 as well.

Figure 3:
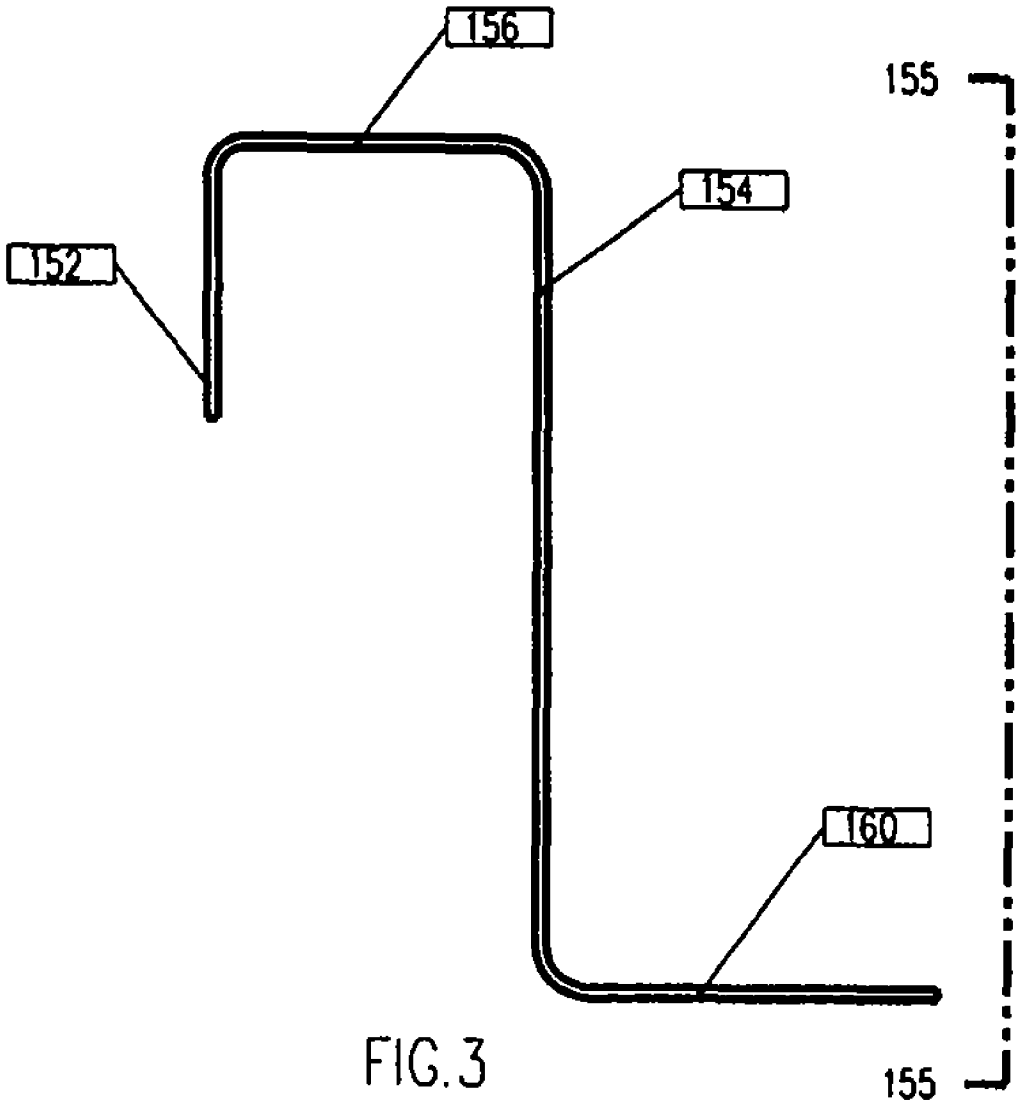
FIG. 3 is a cross-sectional view of the female portion of a roof panel.

FIG. 3 depicts a female end portion 155 of a panel (partially shown as 160) with an elevated end portion 154 that bends substantially 90 degrees from the plane of the panel 160 that leads into a top end component 156 that bends substantially 90 degrees from the plane of the elevated end component 154 and away from the panel 160 and is substantially parallel to the panel itself 160. Another substantially 90 degree bend in the material then leads to an edge portion 152 being the edge of the entire panel 160 on the female portion side 155. This edge portion 152 is parallel with the elevated end component 154. The top end component 156 is raised to a predetermined height in relation to the height of the male portion side (115 of FIG. 2) in order to permit snug engagement of the male portion side (115 of FIG. 2) under and within the female portion side 155. As well, the edge portion 152 is provided at a length longer than that of the male portion side edge portion (112 of FIG. 2) in order to accomplish this snug fit in addition to permitting effective seaming of the two portion sides (115 of FIGS. 2 and 155 of FIG. 2). Each panel used in roof construction will have one male side portion and one female side portion (as alluded to in FIG. 1, above).

Figure 4:
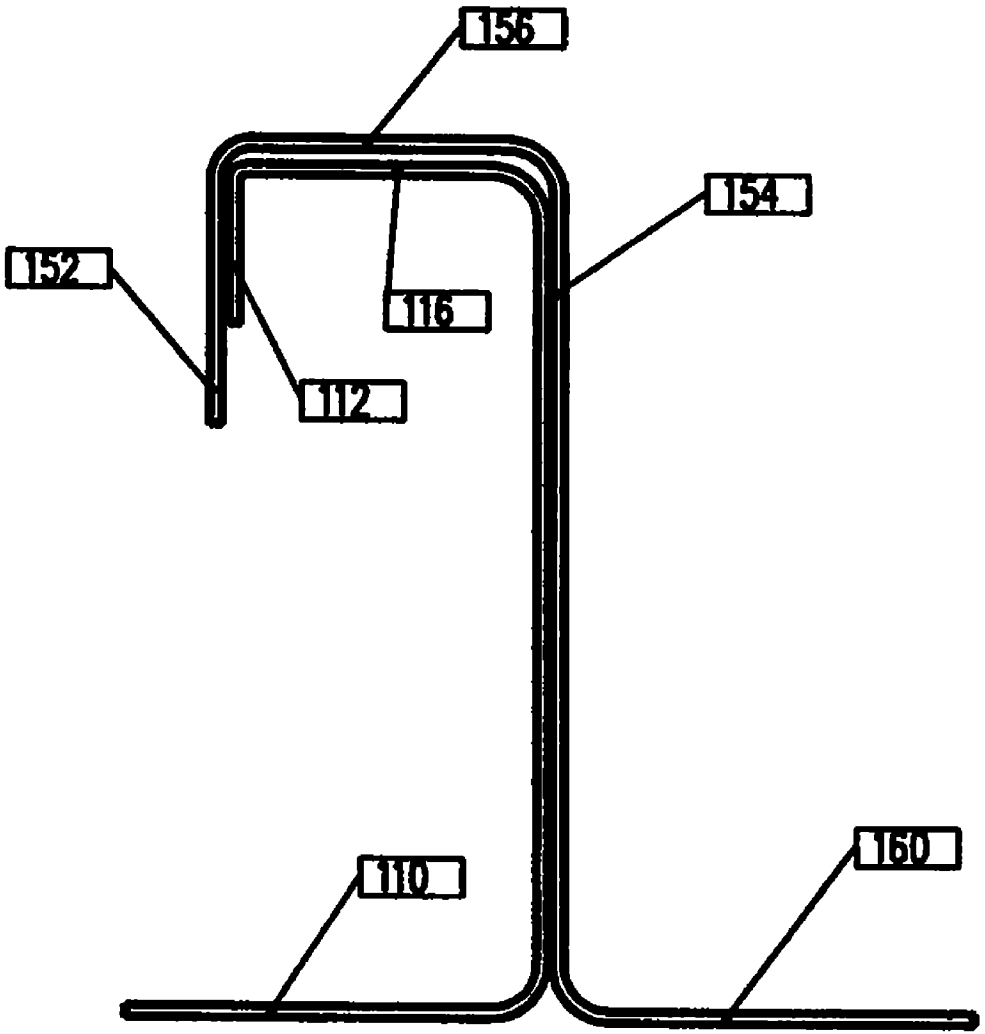
FIG. 4 is a cross-sectional view of interlocked female and male portions of two roof panels prior to seaming.
Figure 5:
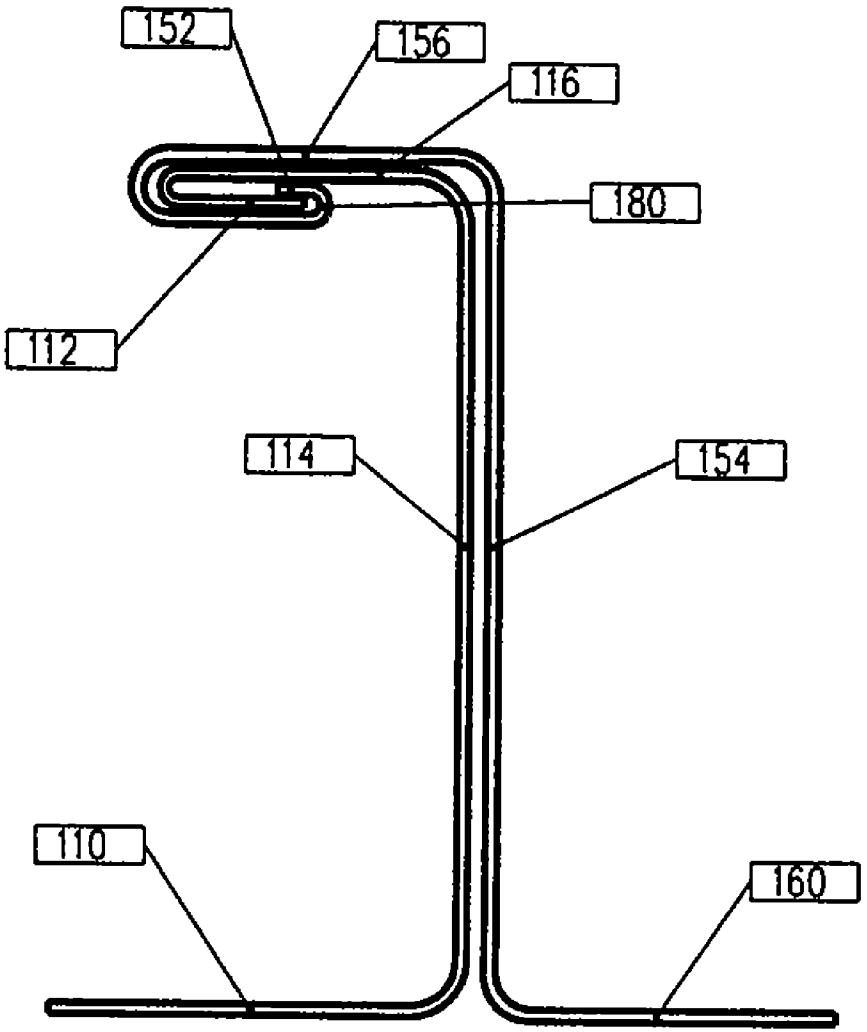
FIG. 5 is a cross-sectional view of interlocked female and male portions of two roof panels subsequent to seaming.

FIG. 4 thus shows the engagement of the two portion sides of the two panels 110, 160 through placement of the female elevated end component 154, the female top end component 155, and the female edge portion 152 over the male elevated end component 114, the male top end component 116, and the male edge portion 112. Upon seaming, as depicted in FIG. 5, through the utilization of the inventive seaming apparatus (such as 210 in FIG. 6), the two panels 110, 160 are maneuvered at their male and female edge portions 112, 152 to form a strong seal with a hook 180. The elevated end portions 114, 154 and the top end portions 152, 156 remain in substantially the same shape and dimensions as prior to seaming. This resultant seamed combination of roofing panels is thus repeated in sequence with a plurality of such panels to form a roof (as shown in FIG. 1).

The remaining FIGS. 6-17) depict the same potentially preferred apparatus in different stages of potential utilization for seaming a target interlocked set of roofing panels (as shown in FIG. 5). It is important to note, however, that this apparatus is but one of many possible configurations that comply with the basic invention. The basic limitation is the simultaneous adjustability through the same control mechanism of the contact angle and engagement of at least one seaming roller and a damping mechanism present external to a base module. The proceeding depictions show a hook-producing apparatus that produces robust seals during seaming; again, this is not a required configuration, but one potentially preferred design including the necessary seam roller/damping post simultaneous control.

The components of the apparatus may be of virtually any material of suitable strength to impart sufficient torque and resist rupture or any other like structural failure during a seaming operation. Certain parts may be of plastic construction if they are not in contact with the targeted roof panels themselves (such as handle covers, adjusting shafts, and the like) or used as wheel components. To initiate the seaming process, it may be necessary for the installer to utilize a manual crimper on the first few inches of the target overlapping panels.

As depicted, then, in all of the remaining FIGURES, a seaming apparatus 210 is provided with a base component 212 including lower arms 214, 216 (two other arms shown in FIG. 8 as 213 and 215) to which rotatable wheels (216, 218, 220 (as well as 221 in FIG. 8) are attached. The base 212 is designed to straddle an elevated interlocked female/male end portion combination 290 of two roof panels (110, 160 of FIG. 5, for example), wherein the only portions of such panels that are not substantially flat (i.e., in substantially the same plane) are elevated portions 291, 293 and the edges 292. The combination 290 is engaged at the overlapping edges 292 of these panels (110, 160 of FIG. 5). The combination 290 exhibits a vertical elevated portion 291 comprised of the same two panels (110, 160 of FIG. 5) as well as a horizontal top portion 293. The base 212 thus includes a monolithic side portion 219 that runs nearly the full length of the base 212 and is shaped to fit the shape of the vertical elevated portion 291 of the combination 290. Also included are inner wheels 295, 296, 297, 298, 299 (FIG. 7) that are configured to rest on the horizontal top portion 293 and move along the entire combination 292 in that manner during utilization.

Figure 20:
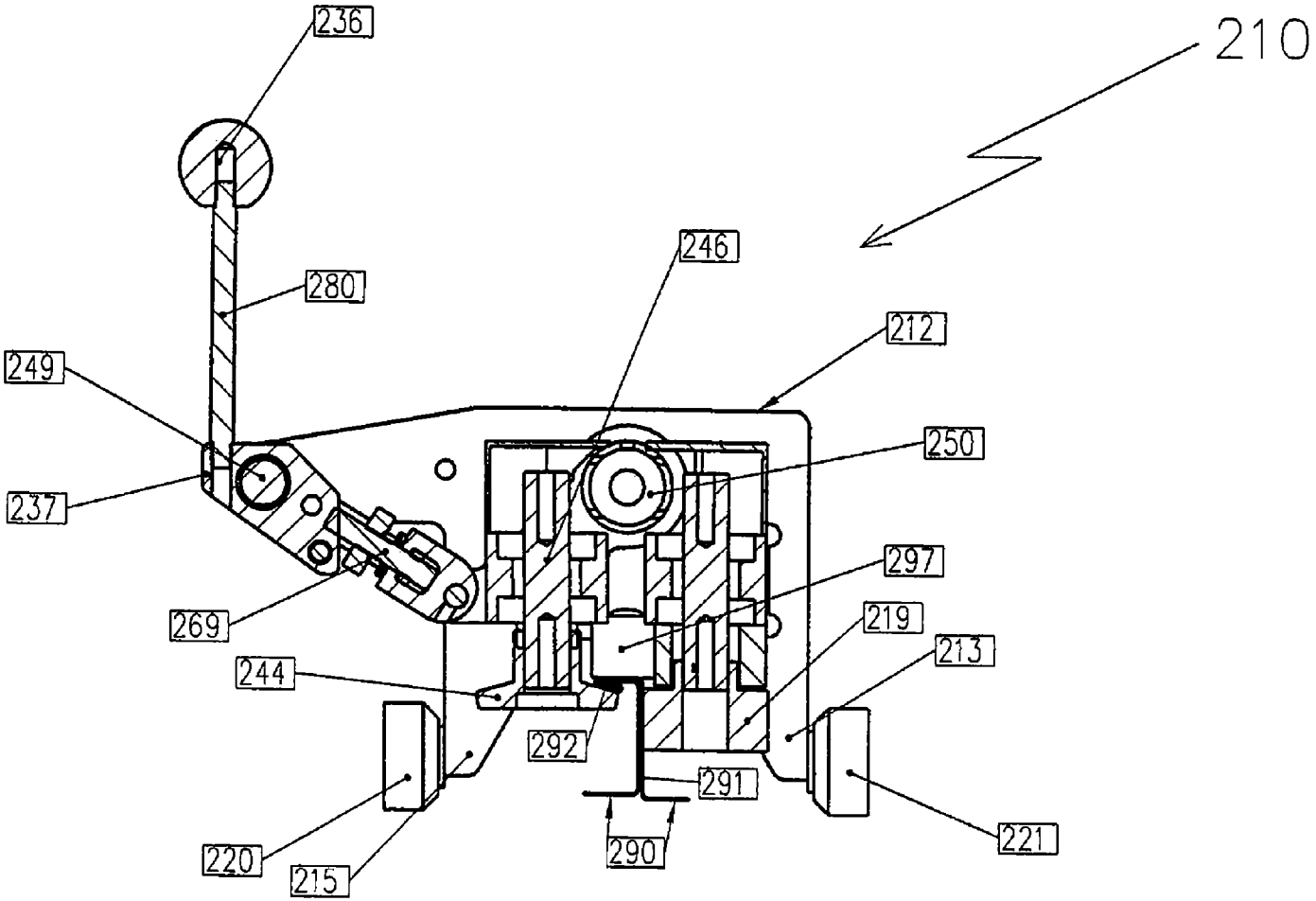
FIG. 20 is a cross-sectional view of the same roof panel seaming apparatus of FIG. 19 along line A thereof during engagement with the interlocked roof panels and all four rollers.

The remaining components of the apparatus 210 are present to effectuate the needed seaming of the overlapping edges 292 along the length of the combination 290. To accomplish such a seaming operation, in this embodiment, there are provided four rollers 228, 240, 242, 244, three of which (228, 242, 244) are oriented horizontally in relation to the target panels (110, 160 in FIG. 5), and one of which is oriented vertically thereto (240). The three horizontal rollers 228, 242, 244 may be adjusted in terms of distance from the overlapping edges 292, as well as in terms of height. It is generally preferred to begin the seaming operation through the utilization of the first horizontal roller 228 disposed at a height lower than the second horizontal roller 242, to initiate the movement of the overlapping edges 292 to a position towards parallel to the top end portion 293. The second horizontal roller 242 then moves the edges 292 to an even closer position to that desired end result. The third horizontal roller 244 is then disposed at a height even higher than the second roller 242 to complete the desired folding of the overlapping edges 292 to the desired parallel position as noted above (such as depicted in FIG. 5). The vertical roller 240 is provided to create the desired hook in the ultimately folded overlapping edges (180 in FIG. 5). This roller 240 is disposed in such a manner as to capture to outer edge of the female end portion (such as 152 in FIG. 4, for example) after the initial pressuring of the outer edges 292 by the first horizontal roller 228 to a proper place in relation to the vertical roller 240. This roller is preferably outfitted with two disks 241, 243 (FIG. 8) that include a flexing spring (not illustrated; such as a Belleville spring) to compensate for wider gauge female end edges (152 of FIG. 4). In this manner, upon movement of the apparatus 210 along the combination 290, the vertical roller 240 takes in the edge (152 of FIG. 4) and forms the desired hook (180 of FIG. 5) during the seaming of the overlapping edges 292 by the horizontal rollers 228, 242, 244. The rollers 228, 240, 242, 244 are all adjustable through lever devices 231, 233, 235, 237 rotatable around the same shaft 249 and including plungers (285 in FIGS. 8 and 11, 265 in FIG. 14, 267 in FIG. 17, and 269 in FIG. 20), attached to shafts 280, 282, 284, 286 that are attached to grip handles 230, 232, 234, 236. In addition, the vertical roller 240 is attached to a separate lever device 239 attached to a handle 238 that allows for extra freedom of movement to adjust the distance from the apparatus 210 the target overlapping edges 292 are present. These adjustable horizontal rollers 228, 242, 244 are also movable up and down through the same controllers 231, 235, 237 via separate shafts 246, 248, 252 to compensate for distance variations with the top end portions 293 as well.

The preferred embodiment of this inventive apparatus 210 includes an adjustable panel guide comprising a damping post 224 attached to a monolithic movable portion 226. The guide is further, preferably, attached to the controller 231 for the first horizontal roller 228 to permit uniform movement of the two apparatus components. In this manner, the panel guide permits uniform initiation of pressing the overlapping ends 292 into the desired folded end configuration (such as in FIG. 4). At times, the roof panels may exhibit nonuniform shapes, particularly at the end portions thereof (for example, the edge portion of a female end portion may splay outward at an angle greater than 90 degrees the top portion position). In such a situation, the initial movement caused by the first horizontal roller may actually be detrimental to the overall roof assembly as the roller itself merely presses the edges upward and at a slight angle; if the initial angle to the top portion is greater than 90 degree, then the resultant angle of the overlapping edges after the first roller has been applied will be skewed to an improper degree for reliable further roller treatments. The ultimate seam may be skewed and unreliable, or, even worse, the apparatus may become stuck during seaming. Such a possibility is highly undesirable, particularly due to the manpower forces necessary to extract the apparatus in such a situation, and more so due to the inherent safety problems that may exist due to the location of the problem itself. Thus, such a panel guide is designed to prevent the initial folds by the first roller from exhibiting improper angles. The damping post 224 is designed and configured to press against the overlapping edges 292 on the side opposite the elevated vertical portion 291 of the combination 290. Being attached to the same controller 231 as the first horizontal roller 228, the disposition of the post 224 is thus, as noted above, substantially uniform to the necessary starting angle of the first roller 228. The movable portion 226 and the damping post 224 are present outside the actual apparatus base 212 to permit effective initiation of the proper alignment of the overlapping edges 292 with the first roller 228 as well. It is important to note that this is solely a preferred embodiment of the inventive apparatus including such a damping post. Any number of seam rollers may be employed, and may be present in any configuration desired. The important limitation of this invention is the simultaneously adjustability from the same control mechanism for the damping post 224 and at least one roller (228 in the preferred embodiment). The resultant seamed roof assembly will exhibit, as noted previously, a uniform alignment due to the presence of this damping post adjustable in this manner. Thus, any roofing panels (uniform at the outset with one another or not, in terms of angles and lengths of the overlapping edges 292 of the combination 290) may be utilized without any need to estimate the proper alignment of the damping post 224 and the first roller 228 separately. Since they adjust together, one adjustment alone is needed, if at all, and no estimating alignment is required.

Figure 6:
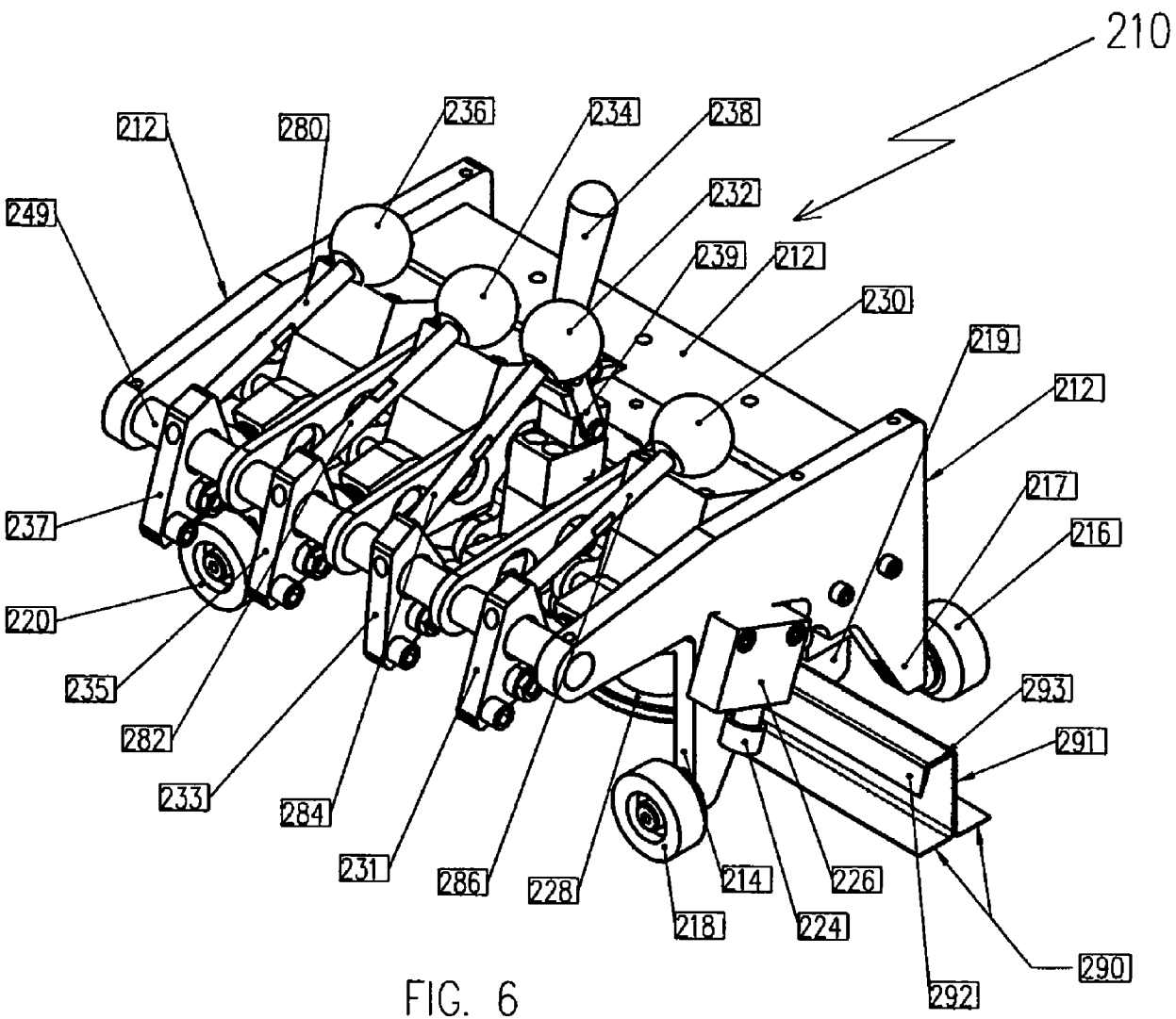
FIG. 6 is an elevated view of one embodiment of an inventive roof panel seaming apparatus placed over an interlocked pair of roof panels prior to engagement thereof.
Figure 7:
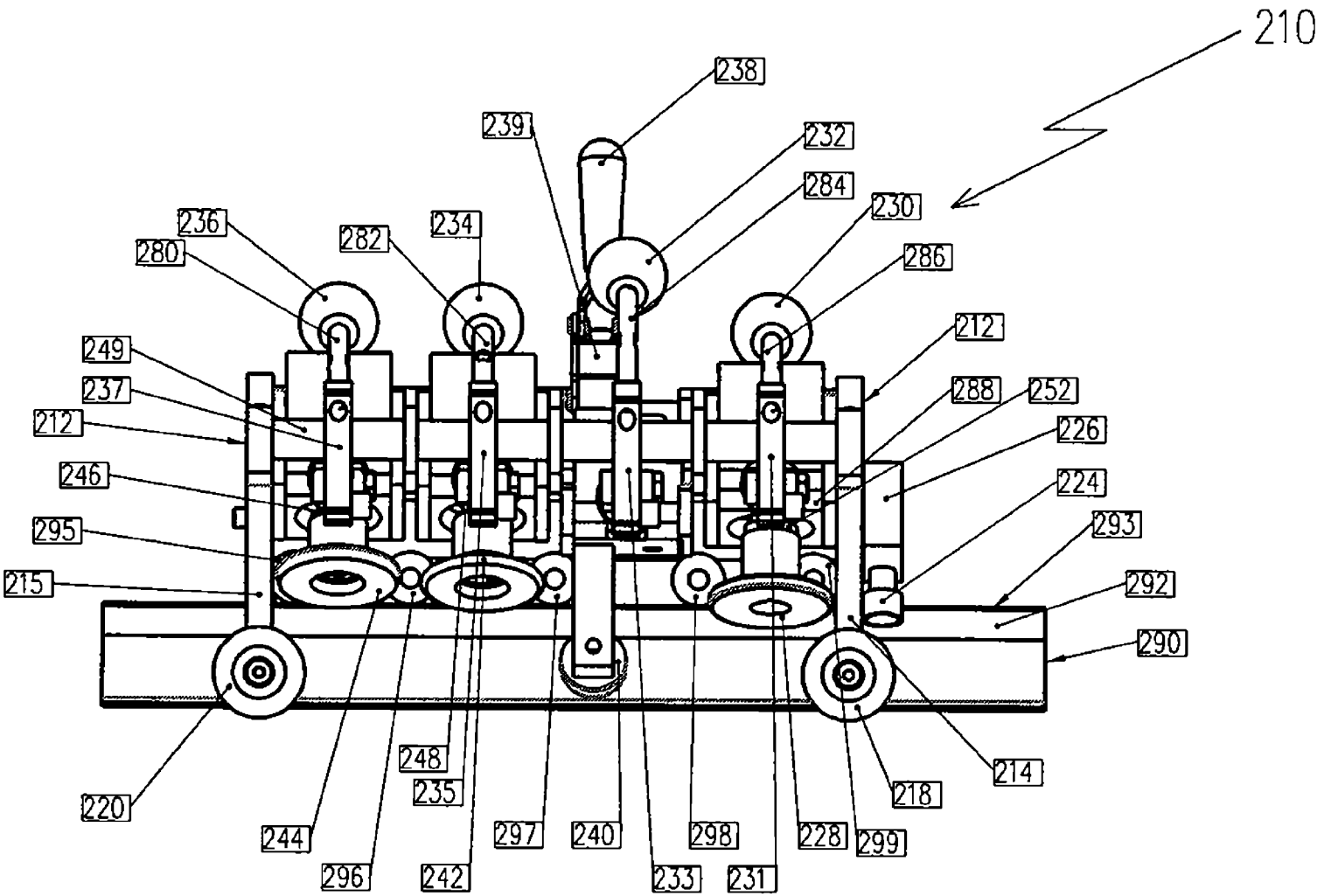
FIG. 7 is a side view of the same roof panel seaming apparatus and interlocked pair of roof panels of FIG. 6.
Figure 8:
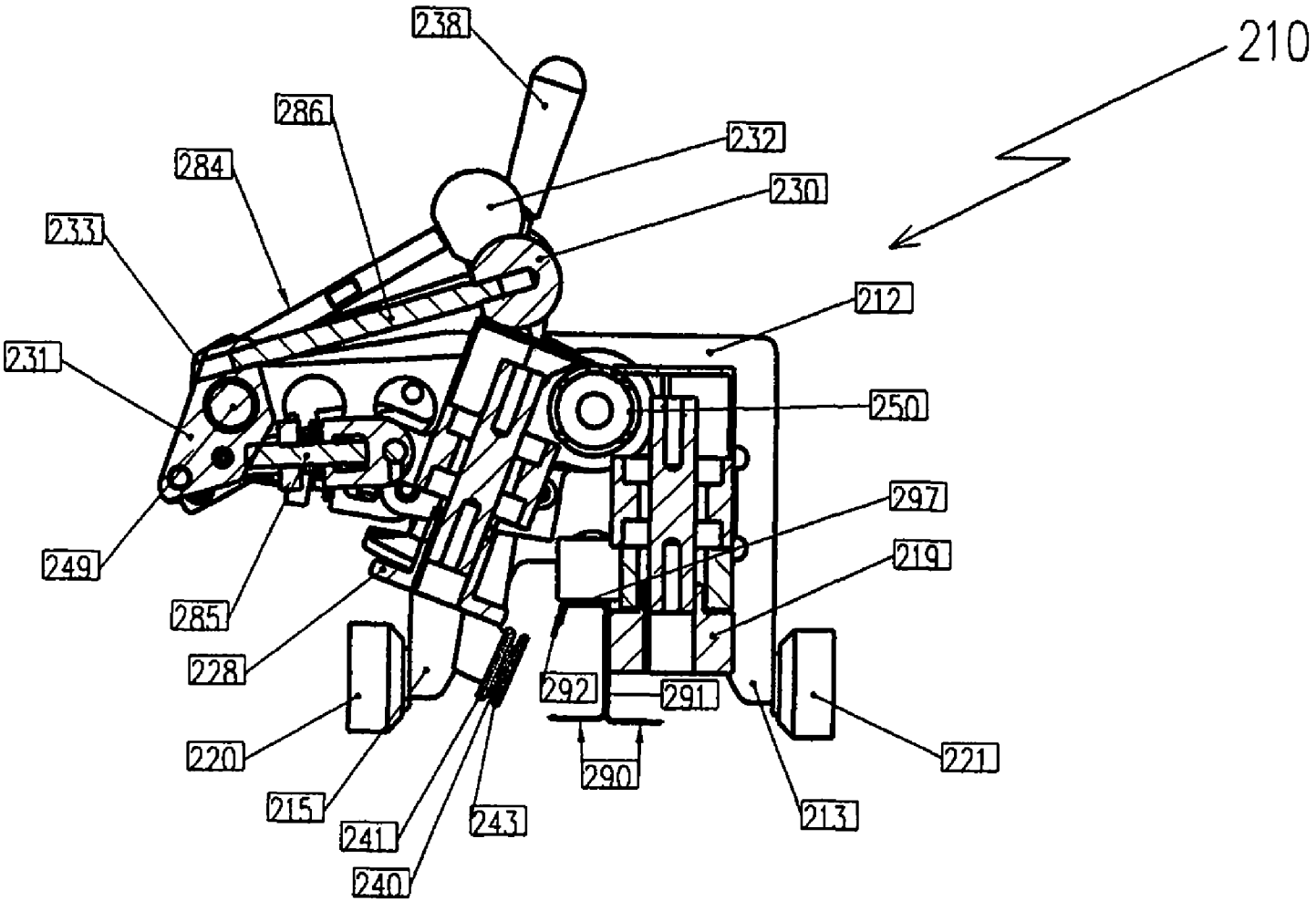
FIG. 8 is a cross-sectional view of the same roof panel seaming apparatus of FIG. 7 along line A thereof prior to engagement with the interlocked roof panels.
Figure 9:
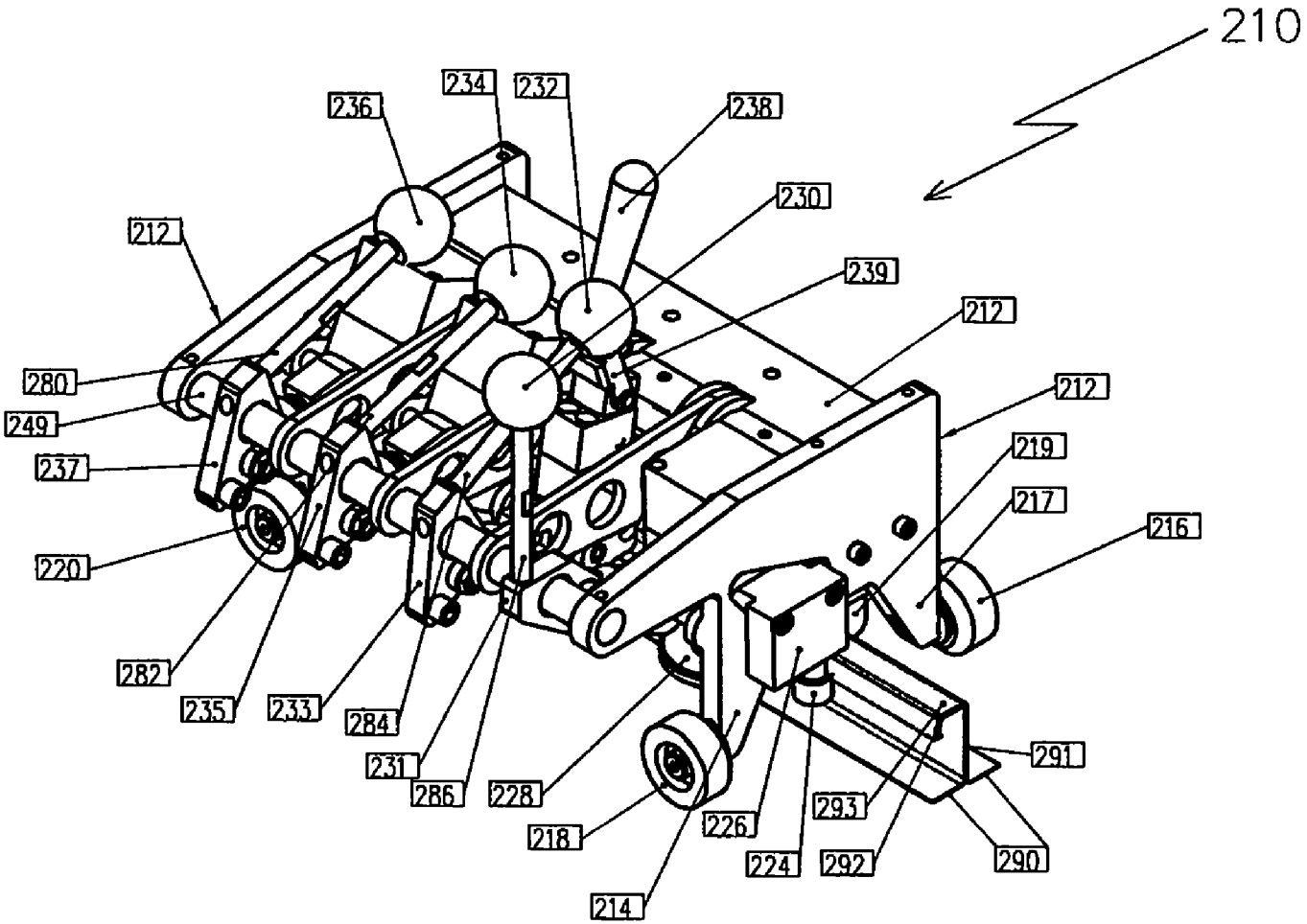
FIG. 9 is an elevated view of one embodiment of an inventive roof panel seaming apparatus placed over an interlocked pair of roof panels with engagement of the first roller thereof.
Figure 10:
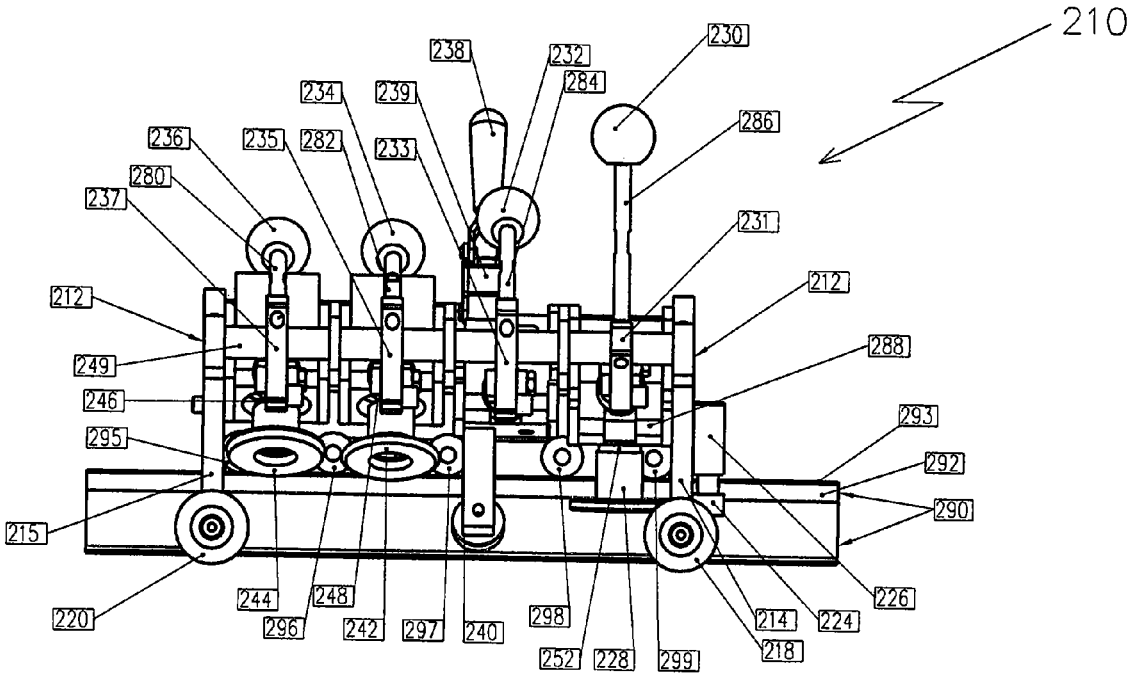
FIG. 10 is a side view of the same roof panel seaming apparatus and interlocked pair of roof panels of FIG. 9.
Figure 11:
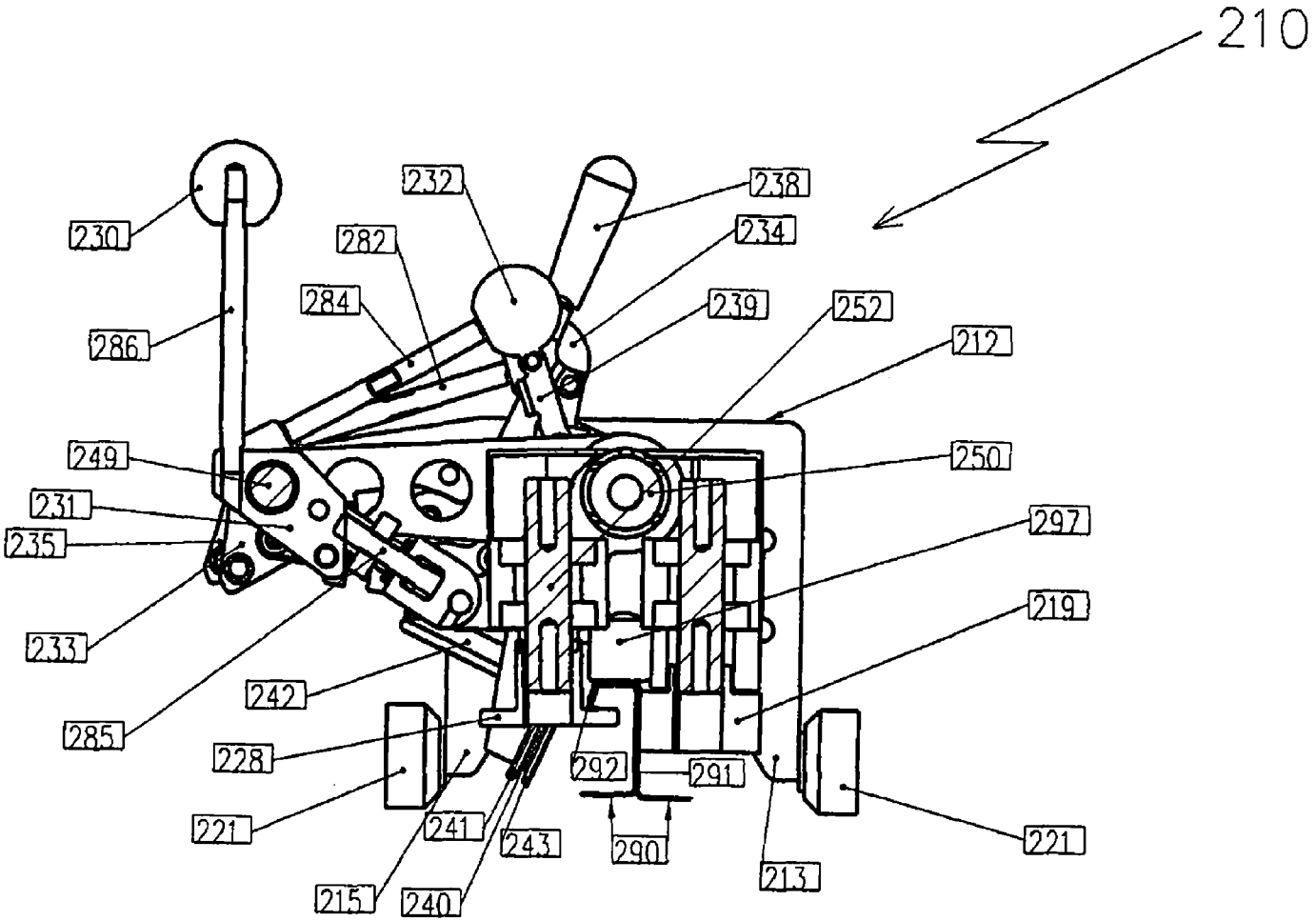
FIG. 11 is a cross-sectional view of the same roof panel seaming apparatus of FIG. 10 along line A thereof during engagement with the interlocked roof panels with the first roller.
Figure 12:
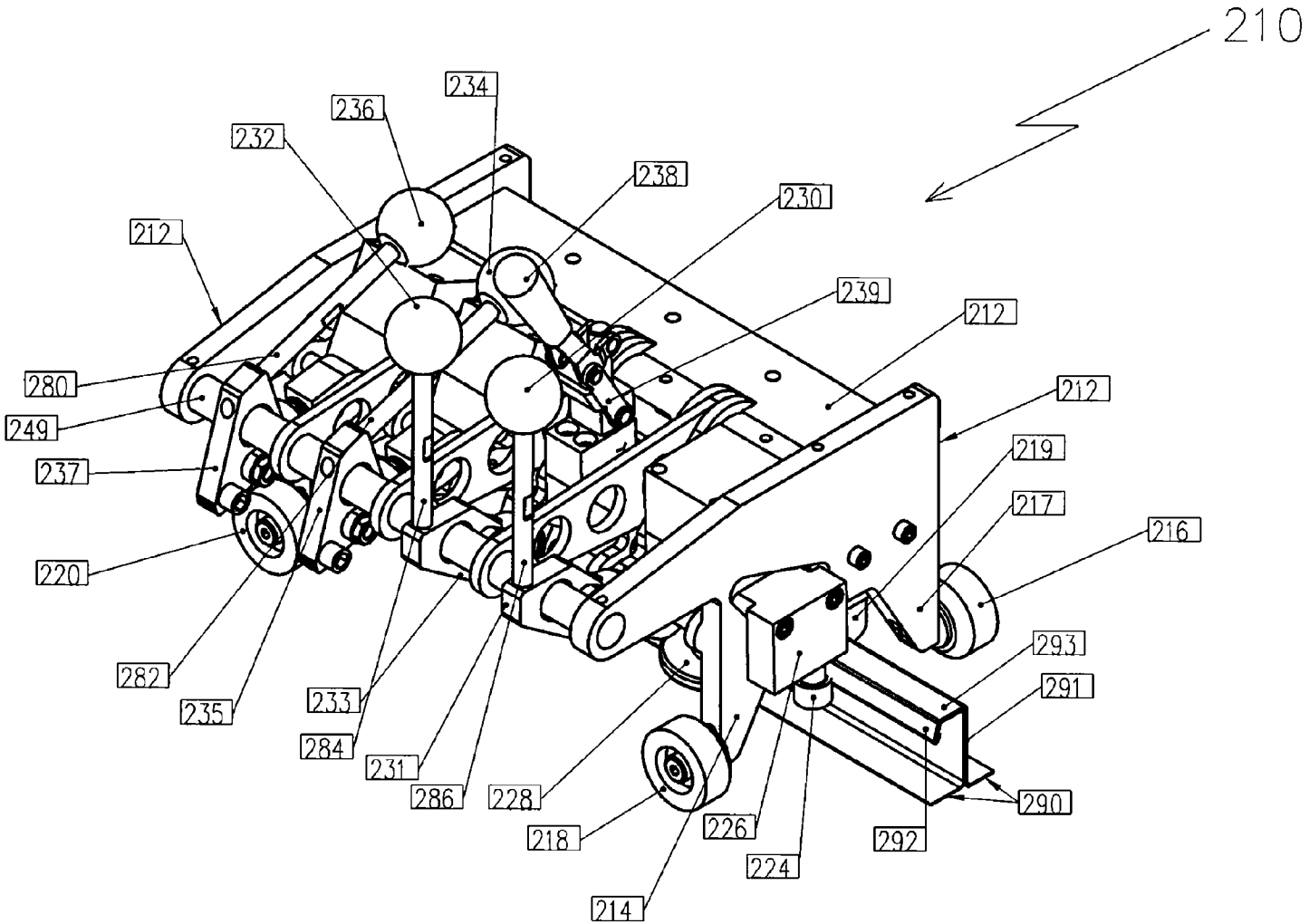
FIG. 12 is an elevated view of one embodiment of an inventive roof panel seaming apparatus placed over an interlocked pair of roof panels with engagement of the first two rollers thereof.
Figure 13:
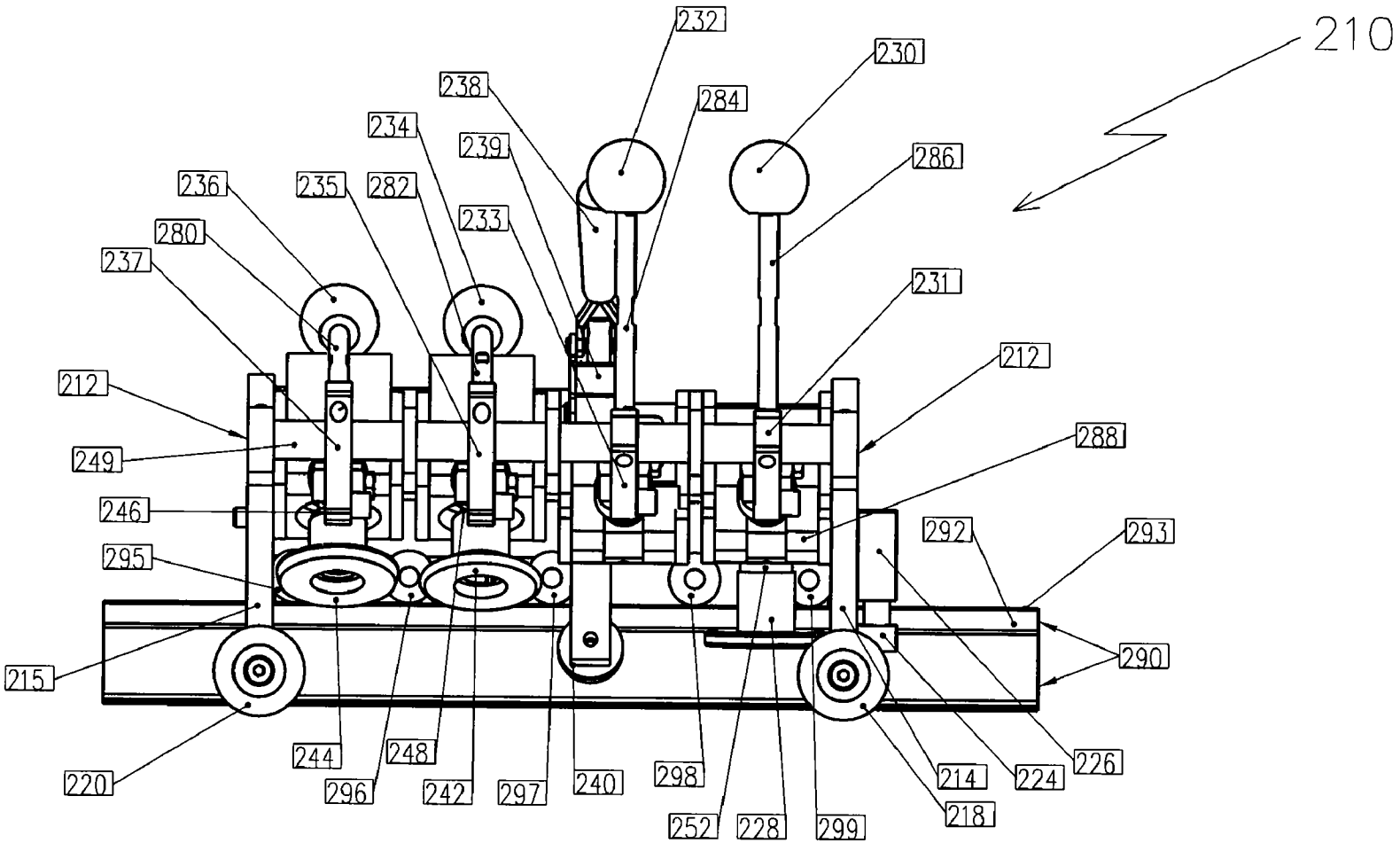
FIG. 13 is a side view of the same roof panel seaming apparatus and interlocked pair of roof panels of FIG. 12.
Figure 14:
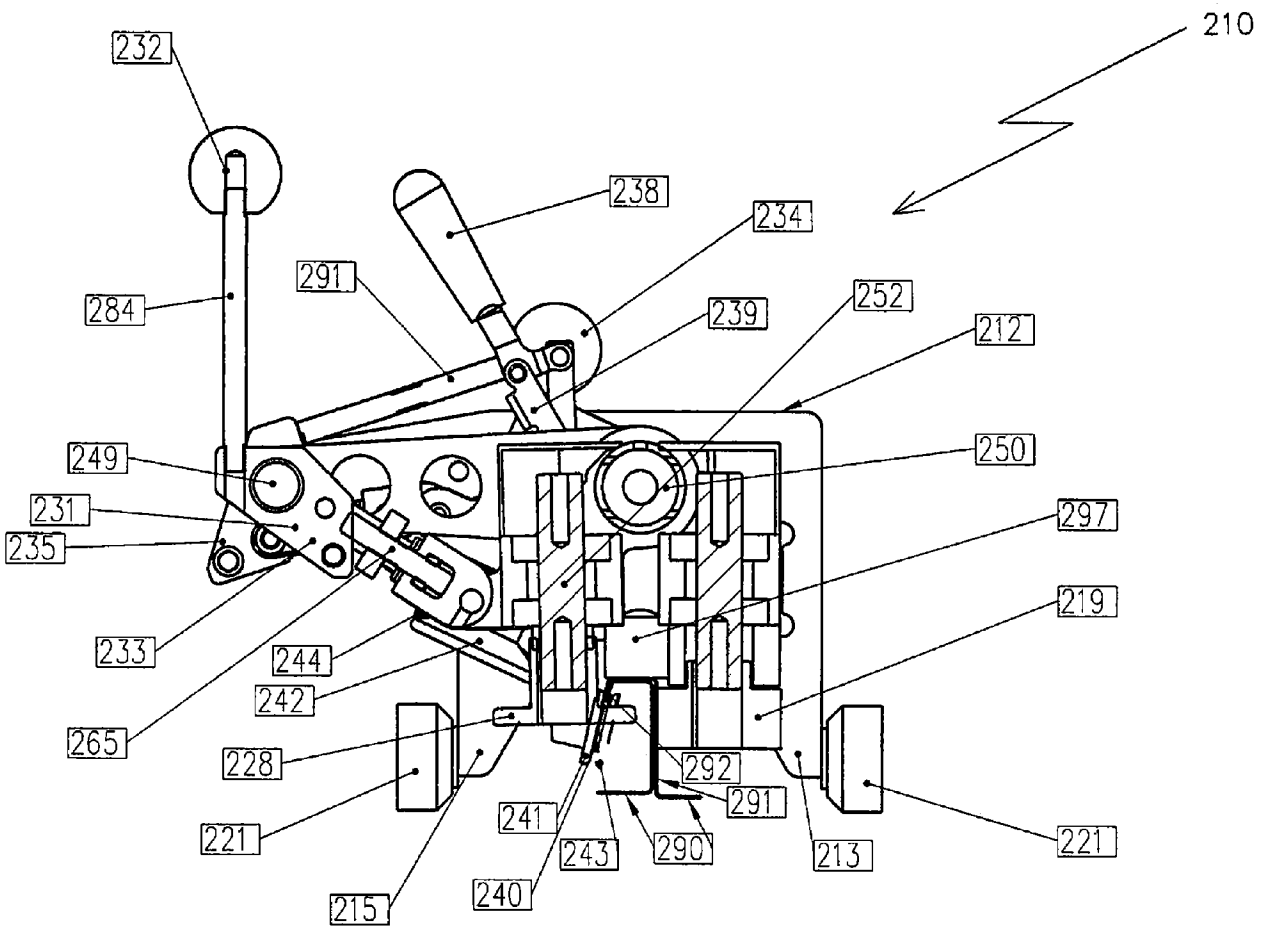
FIG. 14 is a cross-sectional view of the same roof panel seaming apparatus of FIG. 13 along line A thereof during engagement with the interlocked roof panels with the first two rollers.
Figure 15:
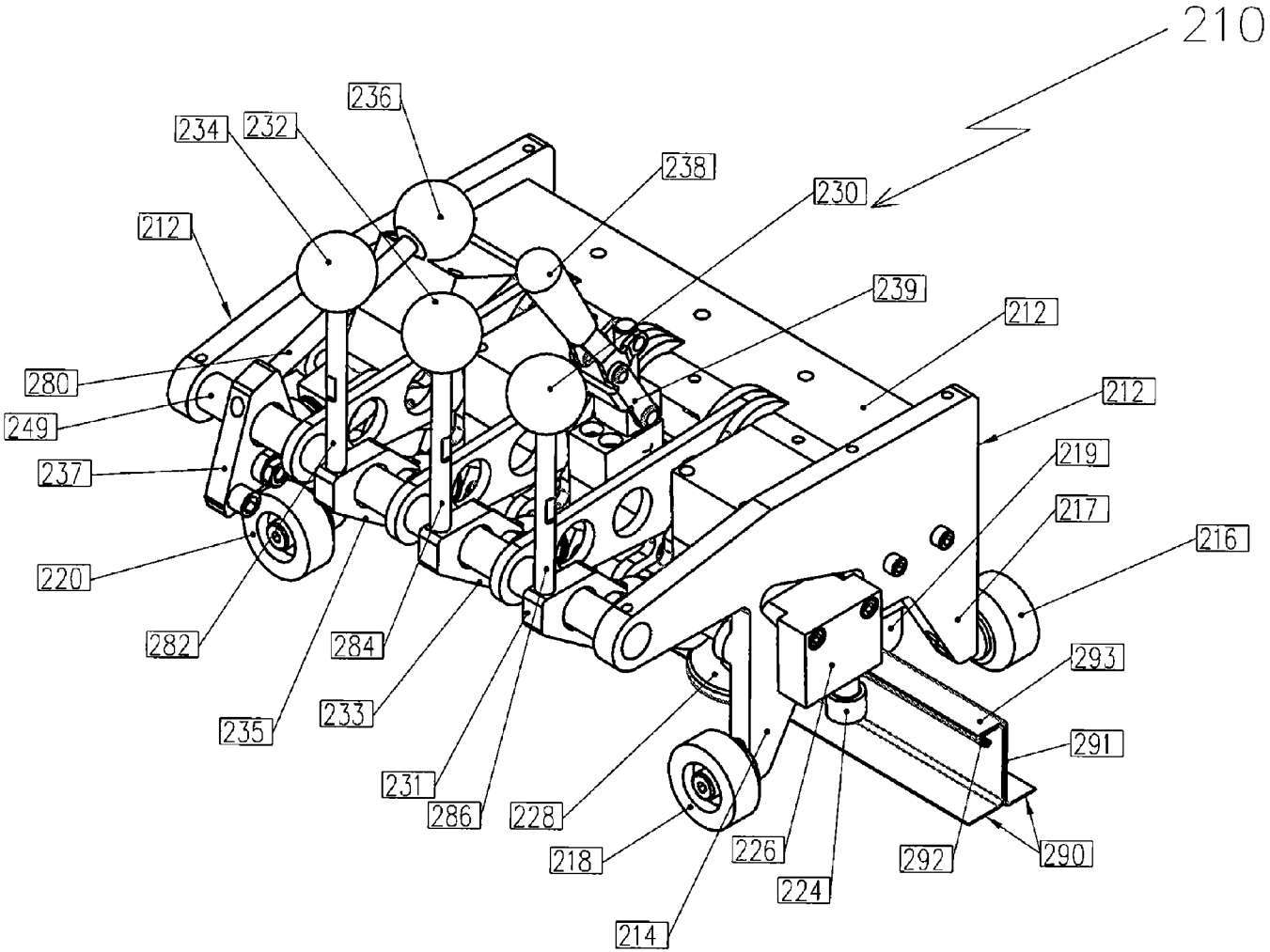
FIG. 15 is an elevated view of one embodiment of an inventive roof panel seaming apparatus placed over an interlocked pair of roof panels with engagement of the first two rollers thereof.
Figure 16:
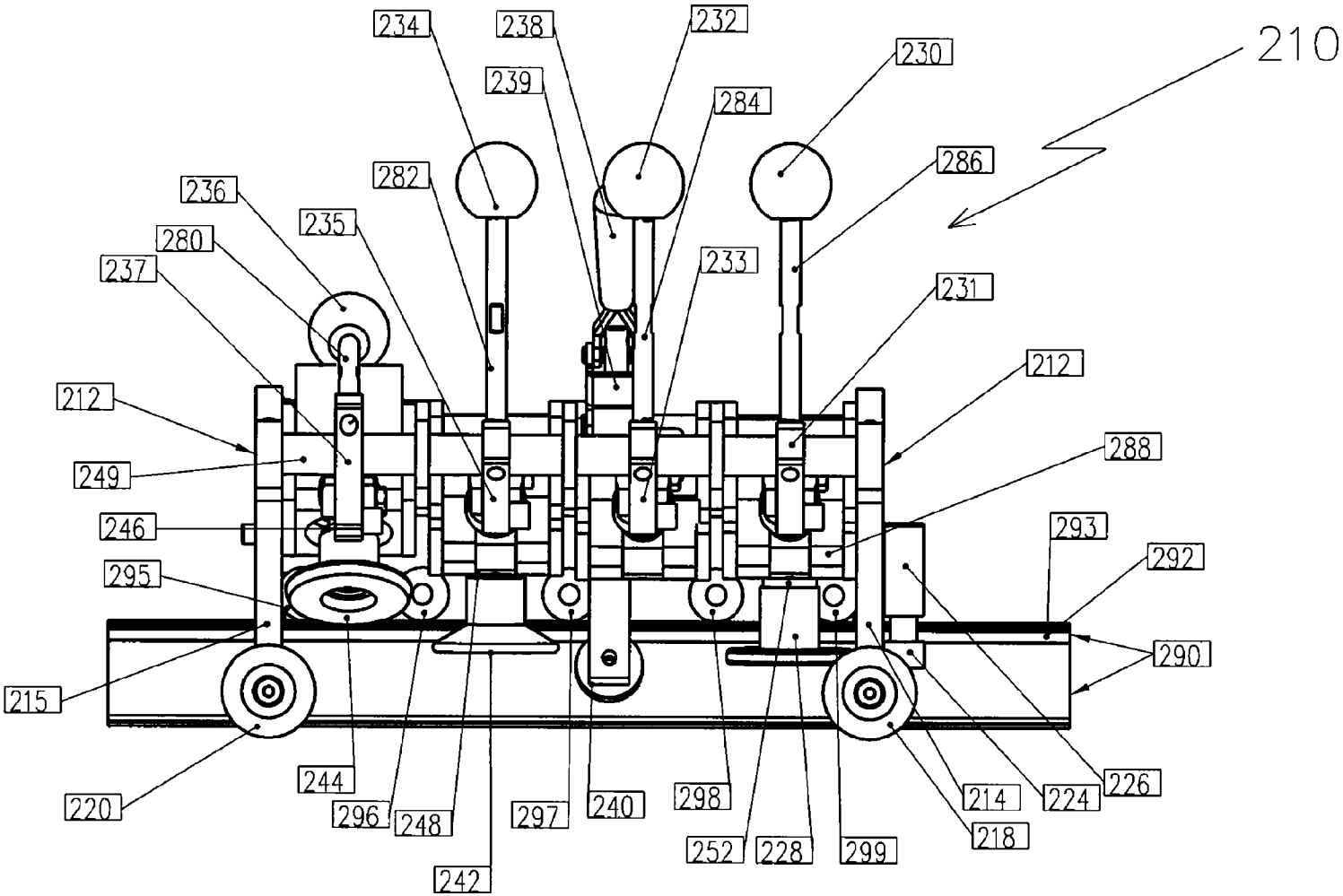
FIG. 16 is a side view of the same roof panel seaming apparatus and interlocked pair of roof panels of FIG. 15.
Figure 17:
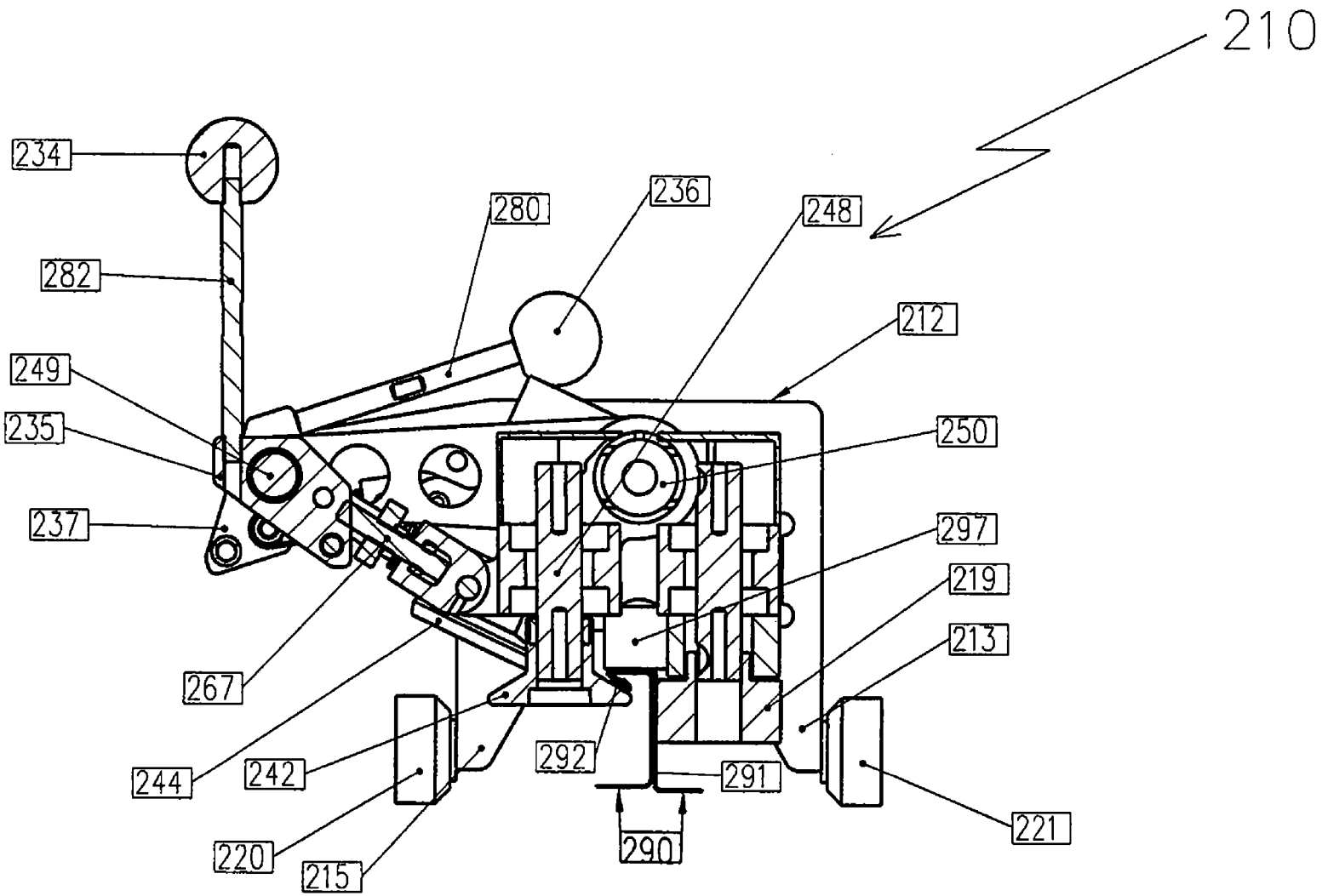
FIG. 17 is a cross-sectional view of the same roof panel seaming apparatus of FIG. 16 along line A thereof during engagement with the interlocked roof panels with the first two rollers.
Figure 18:
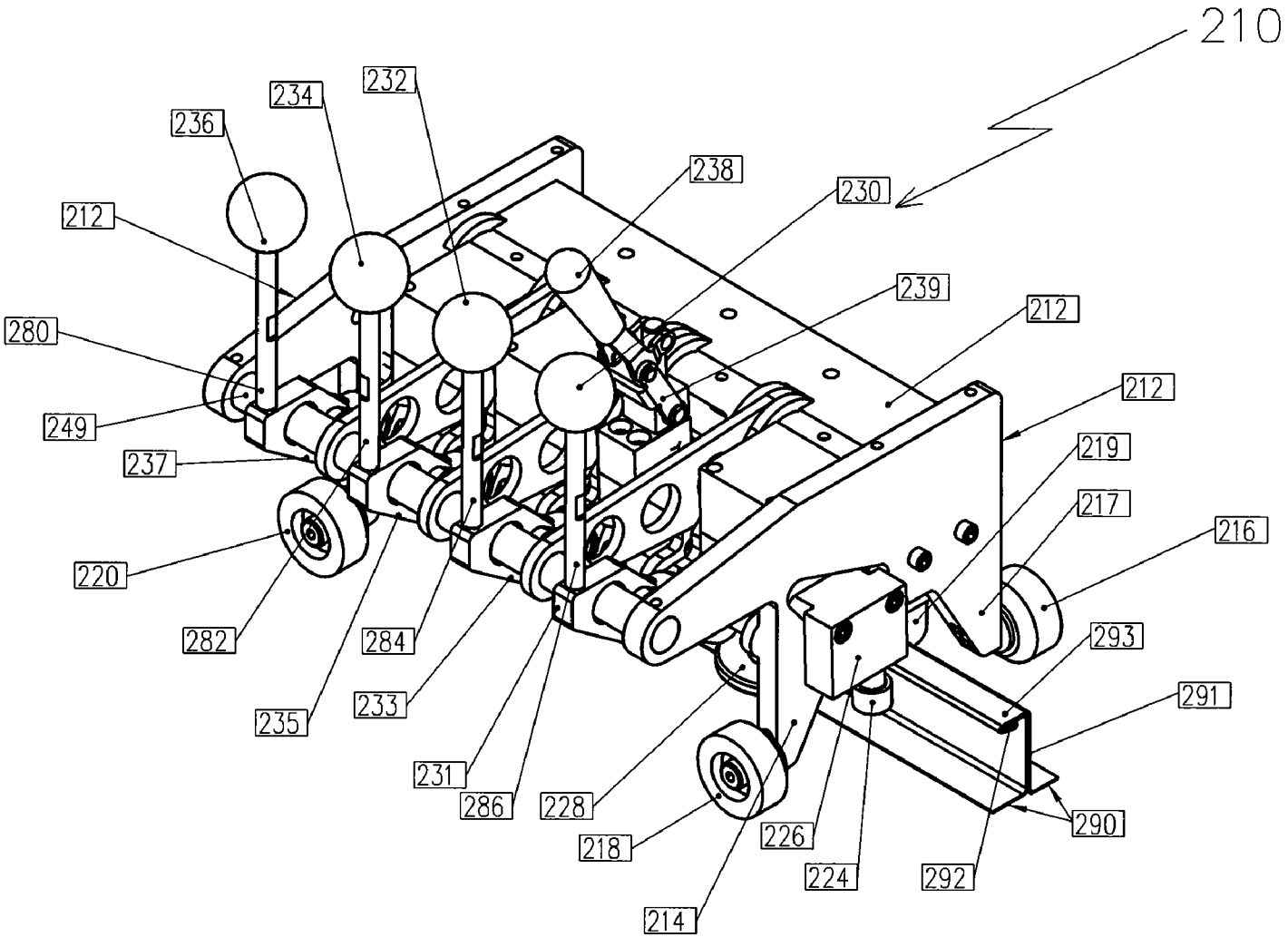
FIG. 18 is an elevated view of one embodiment of an inventive roof panel seaming apparatus placed over an interlocked pair of roof panels with engagement of all four rollers to form the finished hooked seal.
Figure 19:
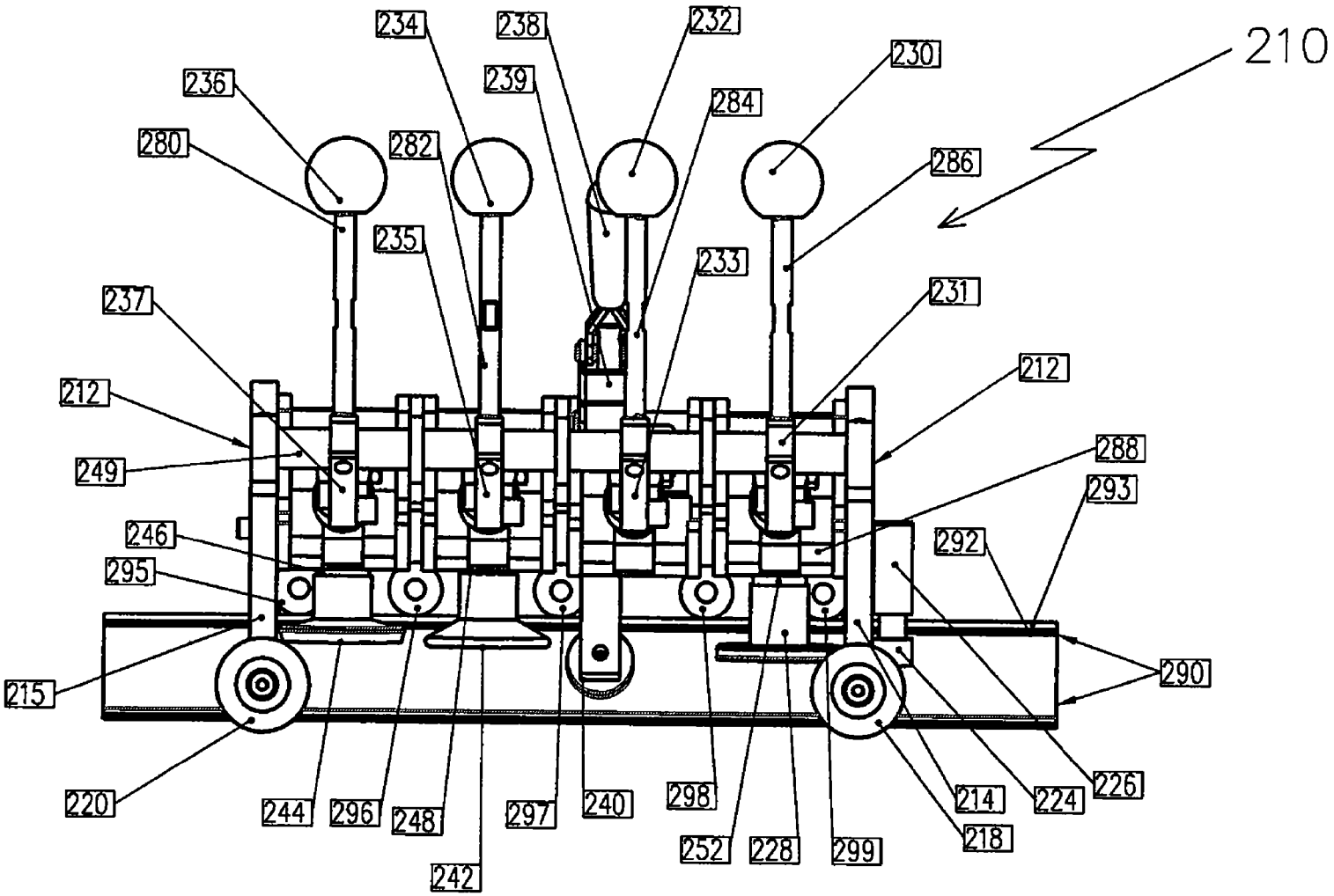
FIG. 19 is a side view of the same roof panel seaming apparatus and interlocked pair of roof panels of FIG. 18.

The entire apparatus 210 is driven by a motor 250 (FIG. 8) to run automatically along the length of the combination 290. For each needed seaming operation, the apparatus may be returned to the same side of the target roof and run along a different set of overlapping edges of roof panels as needed. In FIGS. 6-8, none of the rollers have been engaged for seaming as can be seen as neither the damping post 224 nor the first roller 228 are in contact with the overlapping edges 292 (more easily viewed in cross-section in FIG. 8). In FIGS. 9-11, the first horizontal roller 228 and the damping post 224 have been activated and adjusted to fit the angle of disposition of the overlapping edges 292 through proper adjustment with the lever device 231. The second, vertical roller 240 is then activated and adjusted in FIGS. 12-14 via the adjustment devices 233, 238 to properly align with the outer female edge (152 of FIG. 4, for instance) of the overlapping edges 292 to effectuate the desired hook (180 of FIG. 5). Likewise, in FIGS. 15-17, the third roller (second horizontal) 242 is adjusted through its lever device 235 to a height higher than that of the first roller 228 to create a higher crimp at that station of the apparatus 210. Lastly, as presented in FIGS. 18-20, all four rollers 228, 240, 242, 244 are activated (the fourth 244 through its own lever device 237 to a higher height than the third roller 242 to provide the finished snug crimp up to the bottom of the top end portion 293 of the combination 293.

Thus, through this unique apparatus, a properly crimped and hooked safe and secure roof assembly may be constructed in a relatively safe manner without any pre-hooked panels. In terms of storage and transport, the lack of pre-hooked panels aids in permitting easy stacking of the individual panels without any extra maneuvering to ensure proper nesting for maximum efficiency. Again, in terms of actual utilization, the lack of pre-hooked panels permits simple placement rather than lifting and engaging of the panels during installation on a roof.

Alternatively, an apparatus may be used that includes two sets of each component noted in the FIGURES, but disposed atop the provided apparatus in mirror image to such components. In such a manner, two users may be employed to start the apparatus along one set of roof panels, and the second user may return it to the other by flipping the apparatus over and seaming the next combination of roofing panels as well. Such a process is extremely efficient and is well within the scope of this invention as long as at least one set of components includes the necessary vertical roller to create the hook within the target female edges during a seaming operation. The resultant roof assembly thus exhibits the highly desired level of strength accorded through the inclusion of a hook portion within the final seams thereof, and reduces the complexity of roof assembly itself by merely requiring the placement, rather than actual engagement, of two roofing panels over one another prior to seaming.

It will be understood that various changes in the details, materials, and arrangements of the parts which have been described and illustrated herein in order to explain the nature of this invention may be made by those skilled in the art without departing from the principles and scope of the invention as expressed in the following claims.

What is claimed is:

1. A roof panel seaming apparatus including a plurality of rollers attached in rotatable relation to a base aligned for engagement with female and male roof panel portions of separate but adjacent panels at the same time and at least one damping post present on the apparatus in adjustable relation to at least one of said rollers, wherein said female and male roof panel portions have overlapping edges when placed one over the other in parallel fashion, wherein said rollers create a seam between said female and male roof panel portions when activated along the length of said roof panel portions, and wherein said damping post provides a uniform positioning of said overlapping edges in relation to said at least one roller over the length of said roof panel portions.

2. A method of creating a seam between two roof panels including a female edge portion and a male edge portion present in overlapping relation to one another, said method comprising:

a) providing a first roof panel having an elevated female end portion and an opposite elevated male portion, said female portion having an edge, and said male portion having an edge substantially parallel to said female portion edge, providing a second roof panel substantially identical to and having the same type of female and male end portions as said first roof panel, wherein said first and second roof panels are placed in overlapping, parallel relation to each other, wherein said female end portion of said first roof panel is present over said male end portion of said second roof panel;

b) placing an apparatus including a plurality of rollers attached in rotatable relation to axles aligned for engagement with female and male roof panel portions of separate but adjacent panels at the same time and at least one damping post present on the apparatus in adjustable relation to at least one of said rollers over an initial length of said overlapping female and said male end portions of said first and second roof panels, said apparatus further including at least one control mechanism to adjust the alignment of said rollers and said damping post;

c) simultaneously adjusting said damping post and said at least one roller with the same control mechanism to a proper alignment for seaming of said overlapping end portions;

d) activating said apparatus thereby permitting automatic movement of the apparatus over the overlapping end portions of said first and second roof panels in a direction parallel to the direction in which said first and second roof panels are placed on said roof; and e) removing said apparatus upon completion of movement over said overlapping first and second roof panel end portions.

* * * * *